US005226190A

United States Patent [19]

Lynch

[11] Patent Number: 5,226,190

[45] Date of Patent: Jul. 13, 1993

[54] BASEBALL GLOVE FOR SLIDING

[75] Inventor: Thomas C. Lynch, Mahwah, N.J.

[73] Assignee: Clinton D. Lynch, Mahwah, N.J.

[21] Appl. No.: 777,744

[22] Filed: Oct. 16, 1991

[51] Int. Cl.[5] ..... A41D 13/10

[52] U.S. Cl. ..... 2/19; 2/160

[58] Field of Search ..... 2/162, 160, 161 A, 159, 2/19, 161 R, 20, 16; 273/25, 26 C, 26 R

[56] References Cited

U.S. PATENT DOCUMENTS 1,612,055 12/1926 Rice ..... 2/160
4,042,977 8/1977 Antonious ..... 2/161 A
4,691,387 9/1987 Lopez ..... 2/159 X
4,791,683 12/1988 Agee ..... 2/159 X
4,793,005 12/1988 Hetzel, Jr. ..... 2/161 A

*Primary Examiner*—Clifford D. Crowder
*Assistant Examiner*—Sara M. Current
*Attorney, Agent, or Firm*—Grimes & Battersby

[57] ABSTRACT

The invention relates to a baseball batting glove adapted with a complementary hook and loop fastening means portion to the external back surface with a flap attached to the fastening means surface. This flap may be released from the fastening means surface and held by the batter in the palm of his batting gloved hand when running bases to reduce the likelihood of hand injuries.

8 Claims, 2 Drawing Sheets

BASEBALL GLOVE FOR SLIDING

BACKGROUND OF THE INVENTION

1. Field of the Invention

Baseball players wear batting gloves and wrist bands when they are at bat in a baseball game.

When a baseball player is running bases he is required to hold another glove in either hand. There has been a statistical medical determination made that holding a glove in a base runner's hand reduces the risk of hand injury.

The present invention is dedicated to simplifying the procedure and unifying the batter's glove and/or wrist-band wherein a flap held in place by complimentary releasable hook and eye fastening devices such as, for example, Velcro type hook and eye fastening devices on the upper surface of the batter's glove and.or wrist bands may be loosened when the batter becomes a base runner and said flap may be held in player's palm to serve the same purpose as another glove.

This unique "one-step" baseball glove, the preferred embodiment of the invention, serves the baseball player with a double purpose, protection while batting and with a flip of the flap protection while running.

2. Description of Prior Art

U. S. Pat. No. 4,905,321, describes a weight-lifting, power lifting and workout wrist wraps that are of two types, attachable and detachable, to a workout glove with exposed finger sleeves for better grip.

U. S. Pat. No. 4,847,917 introduces a glove adapted to have reasonably secured thereto an ornamental accessory.

U. S. Pat. No. 4,698,851, describes a ski glove.

U. S. Pat. No. 5,003,637 relates to a glove with utility attachment on the external back surface for holding cigarettes, driver's license, credit cards, pens, pencils, comb, mirror, watch, radio, etc.

OBJECT AND SUMMARY OF THE INVENTION

The combined batting glove and running "flap" attached by complimentary releasable hook and eye fastening devices such as, for example, Velcro type hook and eye fastening devices to the exterior upper surface of the batting glove when not in use protects the baseball player when at bat and protects him when running by providing the extra "glove" he is to hold to reduce his risk of hand injury.

The flap, which is held by complimentary releasable hook and eye fastening devices such as, for example, Velcro type hook and eye fastening devices, in the exterior upper part of the batting glove is instantly released by the baseball player when he reaches a base and held in his palms as he is now required to do with an extra glove.

It is the purpose of the instant invention to introduce a "one-step" hand safety glove for the baseball batter. The baseball glove here introduced protects the baseball player while batting and the "flap" attached to the complimentary releasable hook and eye fastening devices on the upper exterior surface of the glove, when released, becomes the required hand-held "glove" to reduce hand injuries while running bases and sliding.

DETAILED DESCRIPTION OF THE PREFERRED EMBODIMENT OF THE INVENTION

FIG. 1

Figure 1:
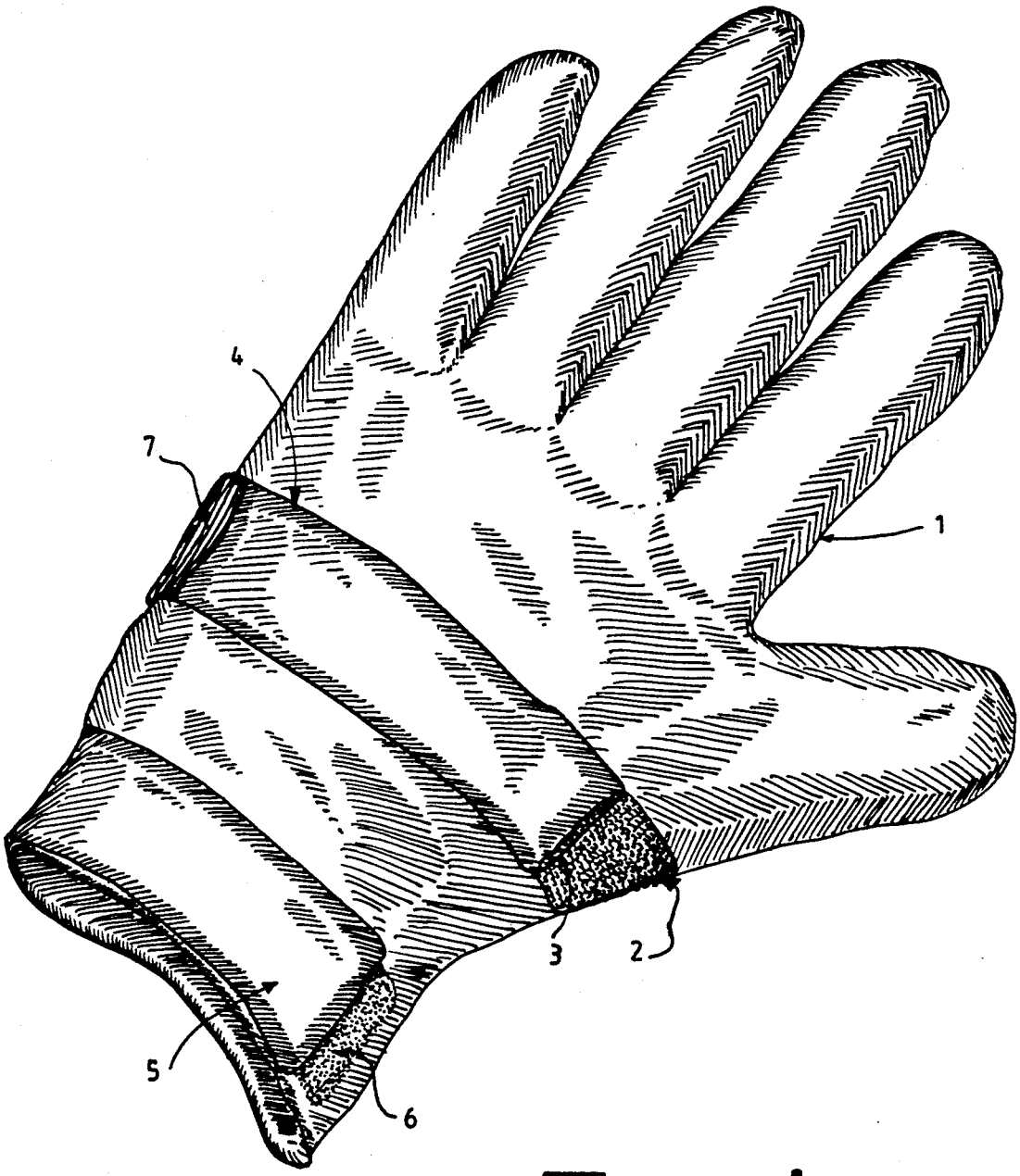
FIG. 1 Baseball Glove for Sliding in Batting Configuration

The baseball glove (1) of the present invention is shown in FIG. 1 in its batting configuration.

The baseball glove (1) is made from a standard protective material, with the wrist wrap (5) flexible according to wrist size and held in place by complimentary releasable hook and eye fastening devices such as, for example, Velcro type hook and eye fastening devices (6) between the wrist flap and upper exterior surface of the glove (6).

The point of the instant invention is the "running flap" (4) which has an inner releasable hook and eye fastening device surface (3) which can band to the complimentary releasable hook and eye fastening device surface (2) or the upper exterior surface of the baseball glove (1).

FIG. 2

Figure 2:
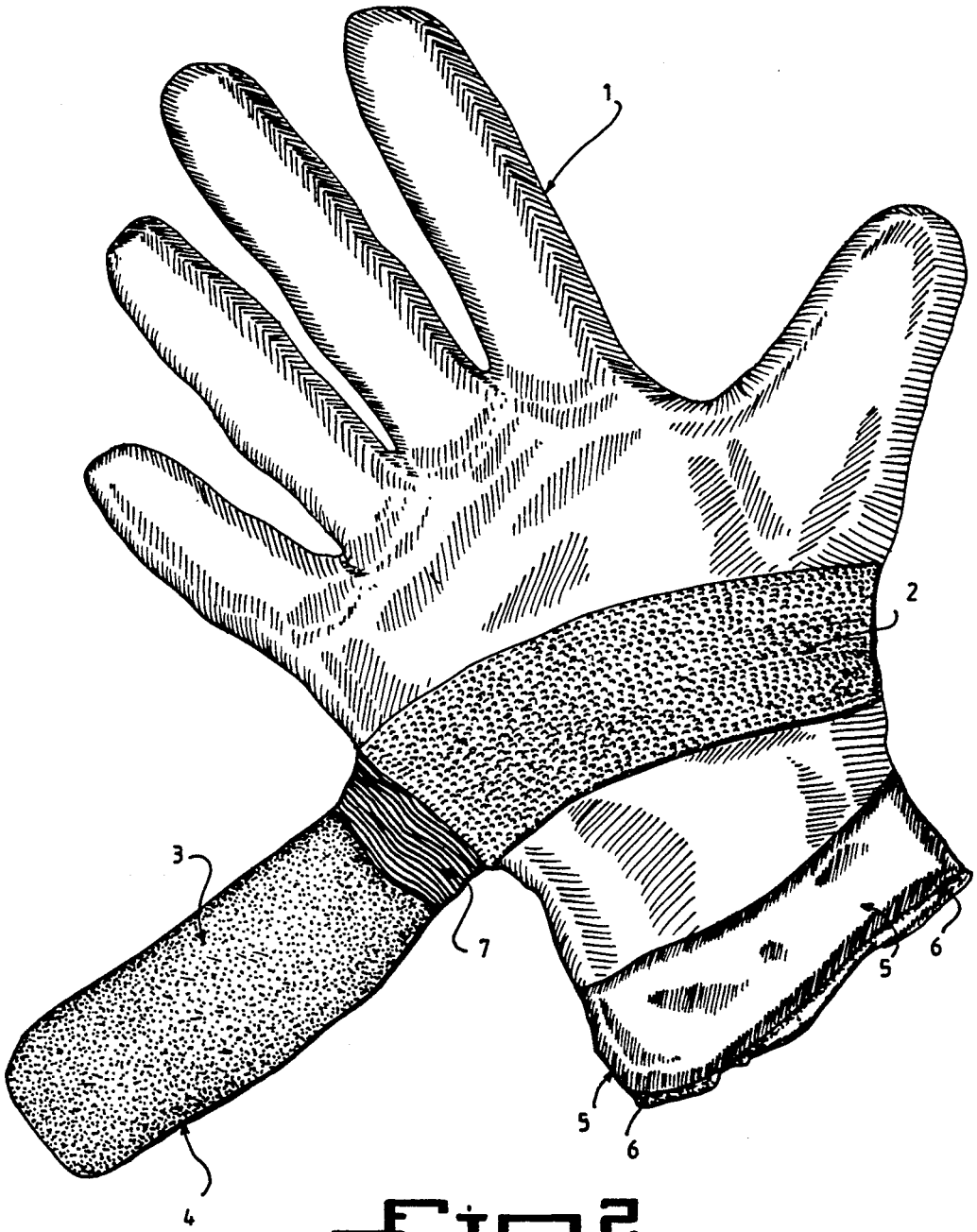
FIG. 2 Baseball Glove for Sliding in Running Configuration

FIG. 2 shows the baseball glove (1) in its running configuration.

The "running flap" (4) is released from the releasable band (2) on the upper exterior portion of the baseball glove (1) and complimentary releasable fastening device band on the "running flap" interior (3) so that the o flap is now loosely held by an elastic band (7) permitting the baseball player to hold "running flap" (4) in his hand while running.

What is claimed is:

1. A method for protecting a baseball player's hand while sliding, said method comprising the steps of:

providing said player with an athletic glove having a top surface and a palm surface, said top surface being defined by a heel edge and a thumb edge, said glove including a running flap secured to said top surface, said running flap including releasable fastening means adapted to engage complimentary fastening means on the top surface of said glove to secure said running flap to said top surface when not in use;

causing said player to release said running flap from said top surface when reaching base, wrap said running flap around an edge of the glove, and grip said running flap between the player's palm and fingers so as to cause the player to assume a fist-like configuration.

2. The method of claim 1 ,wherein the player may maintain the running flap on said top surface of said glove when not in use.

3. The method of claim 1, wherein the running flap may be released and gripped by the player when on base.

4. The method of claim 1, wherein the glove includes a wrist strap.

5. The method of claim 4, wherein the wrist strap includes releasable fastening devices at one end thereof adapted to engage complimentary releasable fastening devices on said glove.

6. The method of claim 5, wherein the releasable fastening devices are complimentary hook and eye fastening devices.

7. The method of claim 1, wherein the running flap is secured to the top surface of the glove by elastic.

8. The method of claim 1, wherein the releasable fastening means on the running flap comprises releasable hook and eye fastening means adapted to engage complimentary hook and eye fastening means on the top surface of said glove.

* * * * *